US007029165B2

(12) United States Patent
Allen

(10) Patent No.: US 7,029,165 B2
(45) Date of Patent: Apr. 18, 2006

(54) AUTOMATICALLY ADJUSTING ANNULAR JET MIXER

(76) Inventor: Thomas E. Allen, 9722 S. Oswego Ave., Tulsa, OK (US) 74137

( * ) Notice: Subject to any disclaimer, the term of this patent is extended or adjusted under 35 U.S.C. 154(b) by 189 days.

(21) Appl. No.: 10/820,892

(22) Filed: Apr. 8, 2004

(65) Prior Publication Data

US 2004/0190368 A1 Sep. 30, 2004

Related U.S. Application Data

(63) Continuation-in-part of application No. 10/002,445, filed on Oct. 26, 2001, now Pat. No. 6,802,638.

(51) Int. Cl.
*B01F 5/02* (2006.01)

(52) U.S. Cl. ..... 366/163.2; 366/178.1

(58) Field of Classification Search ..... 137/888, 137/891–897; 366/152.1, 163.2, 176.2, 178.1, 366/182.4

See application file for complete search history.

(56) References Cited

U.S. PATENT DOCUMENTS

| | | | |
|---|---|---|---|
| 3,188,055 A | 6/1965 | Lutjens et al. | |
| 3,342,959 A | 9/1967 | Breunich | |
| 3,542,342 A | 11/1970 | Barron | |
| 3,643,688 A | 2/1972 | Meinert | |
| 4,125,331 A | 11/1978 | Chisholm | |
| 4,688,945 A | 8/1987 | Brazelton et al. | |
| 4,838,701 A | 6/1989 | Smith et al. | |
| 5,190,374 A | 3/1993 | Harms et al. | |
| 5,382,411 A | 1/1995 | Allen | |
| 5,383,725 A | 1/1995 | Swisher, Jr. et al. | |
| 5,758,691 A | 6/1998 | Nedderman, Jr. | |
| 6,192,911 B1 | 2/2001 | Barnes | |
| 6,802,638 B1 * | 10/2004 | Allen | 366/152.1 |

FOREIGN PATENT DOCUMENTS

GB 2195094 A 3/1998

OTHER PUBLICATIONS

T.E. Allen, Pregel Blender Prototype Designed to Reduce Cost and Environmental Problems, Paper published for presentation at 1994 SPE Permian Basin Oil and Gas Recovery Conference in Midland Texas, Mar. 16-18, 1994.

* cited by examiner

*Primary Examiner*—David Sorkin
(74) *Attorney, Agent, or Firm*—Molly D. McKay

(57) ABSTRACT

An automatically adjusting jet mixer used in mixing fracturing fluid gel for gas and oil wells. The mixer has an inner nozzle and an attached piston that move axially within the mixer's housing to change the size of the nozzle opening thorough which mix water enters the mixer. One side of the piston has a pressure regulated area and an opposite side has an upstream area. The upstream area is connected to the mix water supply pump and the pressure regulated area is connected to the outlet of a pressure regulator that maintains a constant pressure in the pressure regulated area. The piston and the nozzle move via hydraulic pressure exerted on the piston in proportion to the change in pressure in the upstream area to a position that will maintain a constant mixing jet pressure, thus providing constant specific mixing energy, i.e. constant energy per unit mass of fluid.

6 Claims, 7 Drawing Sheets

AUTOMATICALLY ADJUSTING ANNULAR JET MIXER

CROSS-REFERENCE TO RELATED APPLICATIONS

The present invention is a continuation in part of U.S. patent application Ser. No. 10/002,445 for Automatically Adjusting Annular Jet Mixer filed on Oct. 26, 2001 now U.S. Pat. No. 6,802,638.

BACKGROUND OF THE INVENTION

1. Field of the Invention

The present invention relates to an automatically self adjusting annular jet mixer useful in mixing guar and other materials to create a fracturing fluid gel at the site of a gas or oil well.

2. Description of the Related Art

Mixing of guar and other material for creating a fracturing fluid gel has been known for approximately 50 years. Fracturing fluids are used to carry or transport proppant, usually sand, into a well fracture for the purpose of creating improved production of hydrocarbons, i.e. oil or natural gas. In the past, guar gel has had quality problems which were evident by lumps of partially hydrated gel within the gel fluid. These lumps could possible plug off formation permeability and also caused reduced viscosity of the gel. The reduced viscosity was caused by not all of the gel being incorporated into the fluid and thus not being fully utilized. Many efforts, some quite elaborate, have been used to produce a quality gel, i.e. one that was free of lumps. Screens have been used to filter out lumps. Grinders and shear devices have been used to break down the lumps. Chemicals have been used to coat the dry gel powder particles to slow the hydration process and thereby prevent lumps. Guar powder has also been mixed as slurry with diesel fuel to create a concentrated suspension for later mixing into a gel. All these techniques added cost to the material, and depending on the process, added elaborate and expensive equipment. All of these solutions added to the cost of fracturing a well, thus making the produced oil and gas more expensive.

Mixing energy has been found to be an important key to mixing a lump free gel. Guar powder tends to lump if it is not fully wetted when it first encounters water. Thus, a high energy mixer that wets all guar powder particles will create a lump free gel. One of the problems with standard mixers is that the nozzle or jet from which the water exits is usually fixed in size, i.e. the nozzle is not adjustable. If the process rate is changed from the optimal flow for that nozzle, then the performance is changed. If the process rate is less than the optimal rate, then not enough energy will be created to mix the gel free of lumps. In the process rate is much higher than the optimal rate, a high pressure loss is developed in the nozzle which increases required pump horse power and further limits the maximum throughput rate. The most economical fracturing process is one in which the gel is prepared "on-the-fly" at the same time the fracturing fluid is pumped down the well. Guar does need some time to hydrate and develop the desired viscosity. Therefore, a holding tank downstream of the mixer is usually needed before the fluid is mixed with the proppant and is then pumped down the well. Since the characteristics of wells vary greatly, there is a need to mix guar gels at different rates, depending on the stage and well treatment design. The present invention provides a high energy mixer that also automatically adjusts the nozzle size to maintain a high energy nozzle jet to efficiently mix the gel at a wide range of flow rates. The adjustment means employed in the present invention requires no outside power source or control means, whether electronic, mechanical or hydraulic. The water that is used to mix the gel also creates the power that is used to adjust the mixer nozzle. A pressure reducing valve operating on the process water is used to adjust the mixer pressure setting. Once this setting has been made, no other future adjustments are necessary.

SUMMARY OF THE INVENTION

The present invention is an automatically self adjusting annular jet mixer useful in mixing guar and other materials to create a fracturing fluid gel such as employed at the site of a gas or oil well.

The present invention is provided with an inner nozzle member that is axially movable along the mixer centerline to increase and decrease the size of the effective nozzle opening. Integral with the inner nozzle is a piston. The piston is movable within the housing of the mixer, forming a pressure regulated area on one side of the piston and an upstream area on the opposite side of the piston. The pressure regulated area is larger than the upstream area. The upstream area is connected to the mix water supply pump and the pressure regulated area is connected to the outlet of a pressure regulator. The inlet of the the pressure regulator is the same as the upstream side of the piston, i.e. the mix water pump pressure. Although the pressure in the pressure regulated area is preferably provided by regulated supply water, this is not required and the constant pressure in the pressure regulated area can alternately be provided by another source of water or be pressurized by air or other suitable gas.

The pressure regulator sets the maximum pressure of the pressure regulated side of the piston. This pressure, together with the area ratio of the control piston determines the mix water control pressure. If the mix water pressure is lower than required, then the piston moves the inner nozzle member in a direction that will reduce the nozzle outlet size. Reducing the nozzle size increases the backpressure. Conversely, if the mix water pressure is too high, then the piston will move the inner nozzle in the opposite direction to increase the nozzle opening and thus reduce the pressure.

DETAILED DESCRIPTION OF THE PREFERRED EMBODIMENT THE INVENTION

Figure 1:
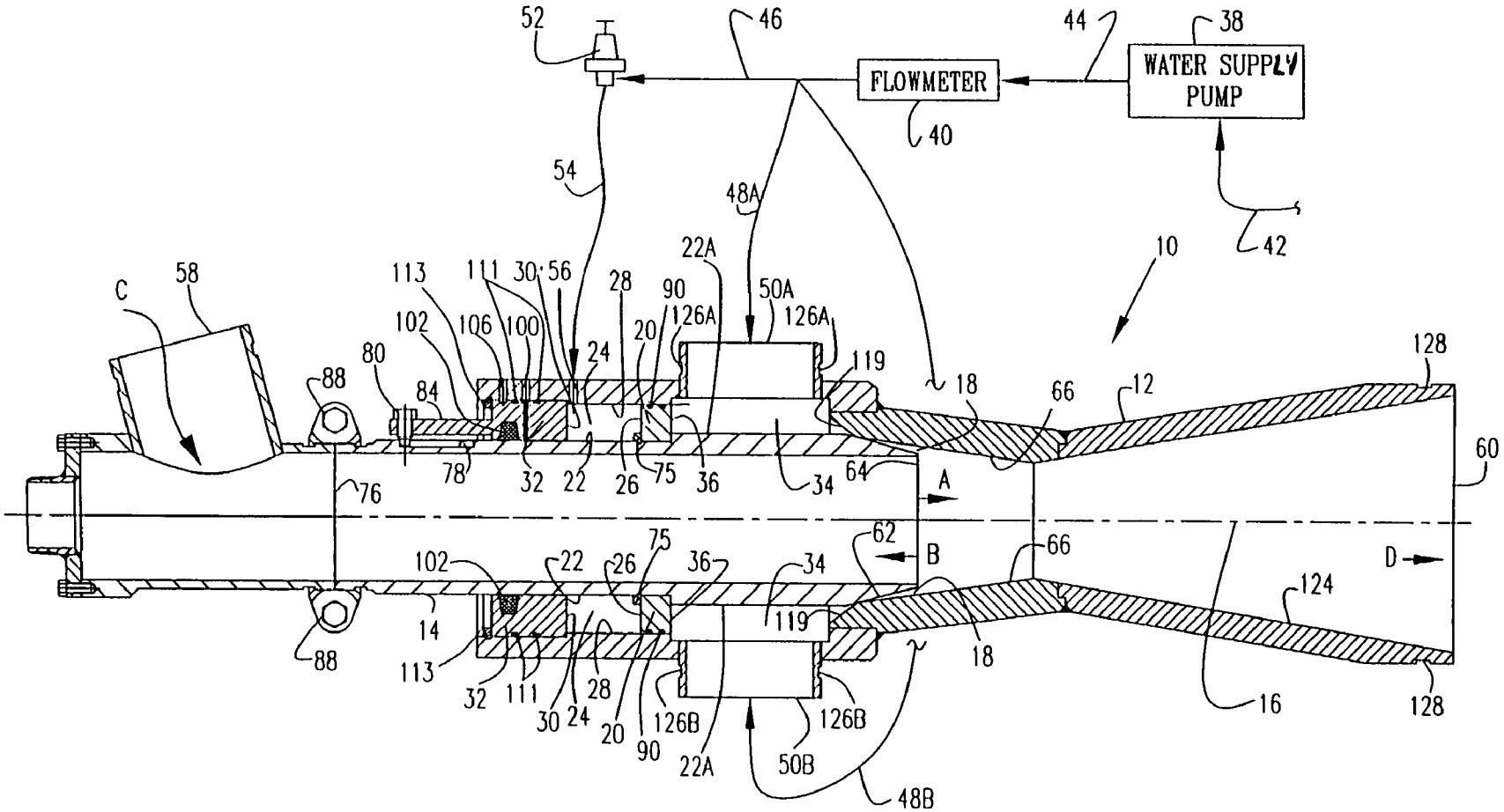
FIG. 1 is a cut away side view of an automatically adjusting annular jet mixer constructed in accordance with a preferred embodiment of the present invention.

Referring now to the drawings and initially to FIG. 1, there is illustrated an automatically self adjusting annular jet mixer 10 that is constructed in accordance with a preferred embodiment of the present invention. The mixer 10 is a type that is useful in mixing guar and other materials to create a fracturing fluid gel at the site of a gas or oil well.

The mixer 10 is provided with a hollow stationary housing 12 and a hollow inner nozzle member 14 that is axially movable along a centerline 16 of the mixer 10 in order to increase and decrease the size of the effective nozzle opening 18. A piston 20 is integrally attached to the inner nozzle 14. The piston 20 encircles an external surface 22 of the inner nozzle 14 so that an enclosed pressure regulated cavity 24 is formed between a first side 26 of the piston 20, the external surface 22 of the inner nozzle 14, an inner surface 28 of the housing 12, and a first end 30 of an alignment member 32. Also an enclosed upstream cavity 34 is formed on an opposite second side 36 of the piston 20 between the second side 36, the external surface 22A of the inner nozzle 14, and the inner surface 28 of the housing 12.

Figure 8:
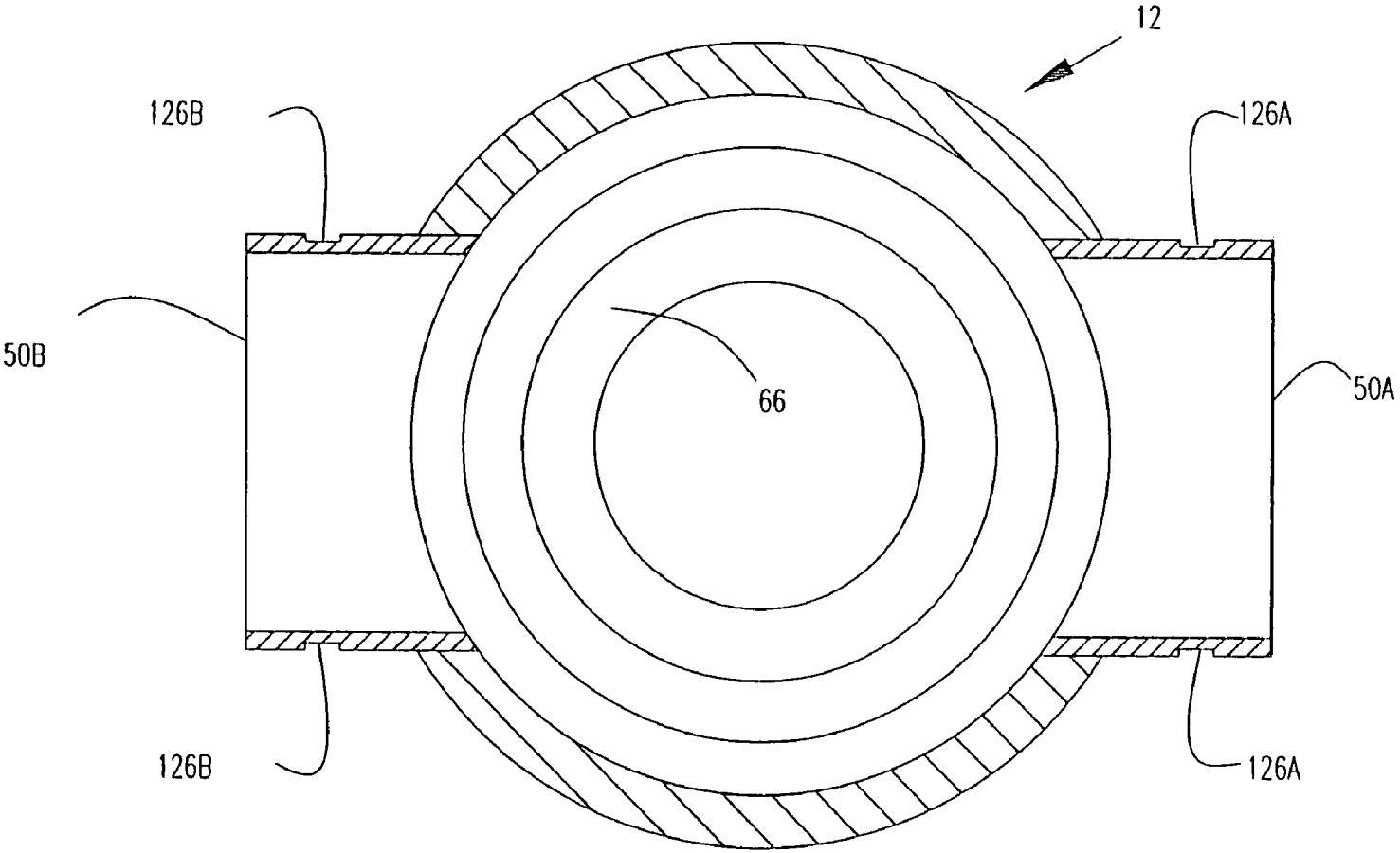
FIG. 8 is an end view of the housing taken along line 8—8 of FIG. 7.

The piston 20 and the attached inner nozzle 14 move within the housing 12 of the mixer 10 as a result of the hydraulic pressure exerted on the first side 26 of the piston 20 via the pressure regulated cavity 24 and the hydraulic pressure exerted on the opposite second side 36 of the piston 20 via the upstream cavity 34. The pressure regulated area of cavity 24 is defined by the projected area along the mixer axis 16 that has an outer diameter of surface 28 and an inner diameter of surface 22. The upstream area of cavity 34 is defined by the projected area along the mixer axis 16 that has an outer diameter of surface 28 and an inner diameter of surface 22A. The pressure regulated area of cavity 24 is larger than the upstream area of cavity 34. The upstream cavity 24 is connected to and receives supply water from the mix water supply pump 38 via a flow meter 40 as shown in FIG. 1 by lines 42, 44, 46, 48A, and 48B. As shown by line 42, mix water is received by the mix water supply pump 38 and is then pumped through the flow meter 40, as shown by line 44. From the flow meter 40, the supply water flows via line 46 and then via lines 48A and 48B to two supply water inlets 50A and 50B, respectively, that are provided in the housing 12 so that both of the supply water inlets 50A and 50B communicate directly with the upstream cavity 34. The location of the two supply water inlets 50A and 50B is best illustrated in FIG. 8.

The pressure regulated cavity 24 is connected to and receives supply water from an outlet of a pressure regulator valve 52, as show by line 54. Line 54 connects to the pressure regulated cavity 24 via a water inlet 56 provided in the housing 12. An inlet of the pressure regulator valve 52 receives supply water from the flow meter 40 via line 46, i.e. the same source that supplies the upstream cavity 34. The pressure regulator valve 52 sets the maximum pressure of the pressure regulated cavity 24 and determines the force exerted on the first side 26 of the piston 20. This pressure, together with the area ratio of the two sides 26 and 36 of the control piston 20 determines the mix water control pressure.

Stated another way, the product of the regulated pressure that is exerted on the first side 26 of the piston 20 and the area of the first side 26 of the piston 20 on which that regulated pressure is exerted will remain equal to the product of the pressure exerted by the water flowing from the mix water supply pump 38 and the area of the second side 36 of the piston 20 on which that pressure is exerted. These two products will always remain equal in the mixer 10 due to the free axial movement of the piston 20 which keeps the forces exerted on the first and second sides 26 and 36 of the piston 20 in balance. Since the pressure regulator valve 52 maintains a constant pressure on the first side 26 of the piston 20 and the area of the first side 26 of the piston 20 is constant and the area of the second side 36 of the piston 20 is constant, the piston 20 moves in proportion to the pressure exerted on the second side 36 of the piston 20 by the mix water supply pump 38. Thus, the mixer 10 automatically adjusts to the flow and the resulting pressure exerted by the flow emanating from the mix water supply pump 38. If the mix water pressure is lower than required, then the piston 20 moves the inner nozzle member 14 in a direction, as illustrated by Arrow A in FIG. 1 that will reduce the size of the nozzle opening or outlet 18. Reducing the size of the nozzle opening 18 increases the backpressure, thus balancing the opposing forces being exerted on the piston 20 via the pressure regulated and upstream areas. Conversely, if the mix water pressure is too high, then the piston 20 will move the inner nozzle 14 in the opposite direction, as illustrated by Arrow B, to increase the size of the nozzle opening 18 and thus reduce the backpressure, thus again balancing the opposing forces being exerted on the piston 20 via the pressure regulated and upstream areas.

Self adjustment of the nozzle opening 18 in coordination with the supply water flow is important since this maximizes wetting of the guar gum powder which enters a powder inlet opening 58 provided in the mixer 10 via the route indicated by Arrow C. This route of entry of the guar gum powder is typical of this type of mixer and the guar gum powder is usually blown via air stream into the mixer 10. It is also possible to have gravity feed of the guar powder to the mixer 10. In addition, the mixer 10 creates a vacuum on the powder inlet opening 58 and thus induces an air flow which is capable of transporting powder to the mixer 10 without other motive means. Any of the three means is a satisfactory method of delivering guar powder to the mixer 10.

Figure 9:
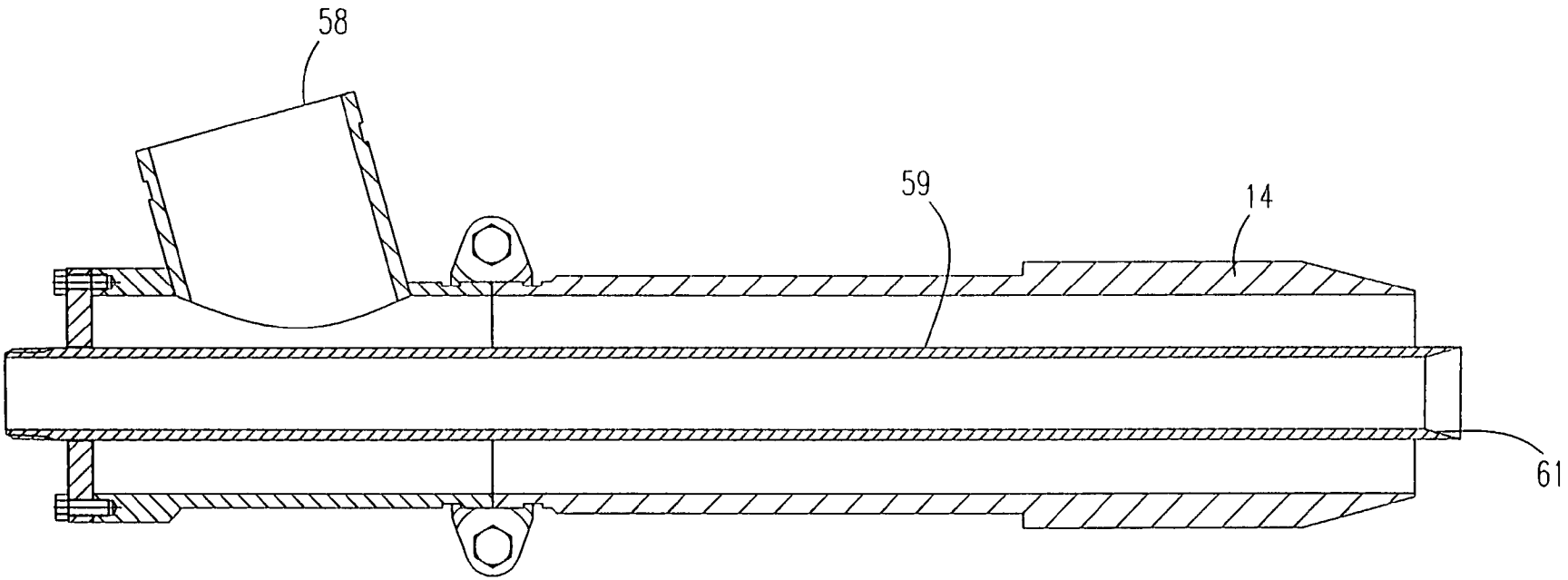
FIG. 9 is a cross sectional view showing an optional central mix water supply pipe located within centrally within the inner nozzle member.

Also, as illustrated in FIG. 9, an optional central mix water supply pipe 59 supplying additional mix water is an option for mixtures requiring higher flow rates or more difficult to mix materials. The central pipe jet 61 provided in the central mix water supply pipe 59 where it terminates within the mixer 10 will add flow capacity and mixing energy. An opposite end of the central mix water supply pipe 59 is connected to a supply of mix water. The mix water and the guar gum powder are thoroughly mixed together in the mixer 10 immediately downstream of the nozzle opening 18 and the guar gum mixture exits the mixer 10, as illustrated by Arrow D in FIG. 1, via a mixture exit opening 60 provided in the housing 12 of the mixer 10. Subsequent to exiting the mixer 10, entrained air is removed from the mixture via traditional means and the guar gel mixture is then ready to be pumped into an oil or gas well as part of a fracturing job. As previously noted, guar does need some time to hydrate and develop the desired viscosity, and therefore, a holding tank downstream of the mixer 10 is usually needed before the fluid is mixed with the proppant and pumped down the well.

Figure 2:
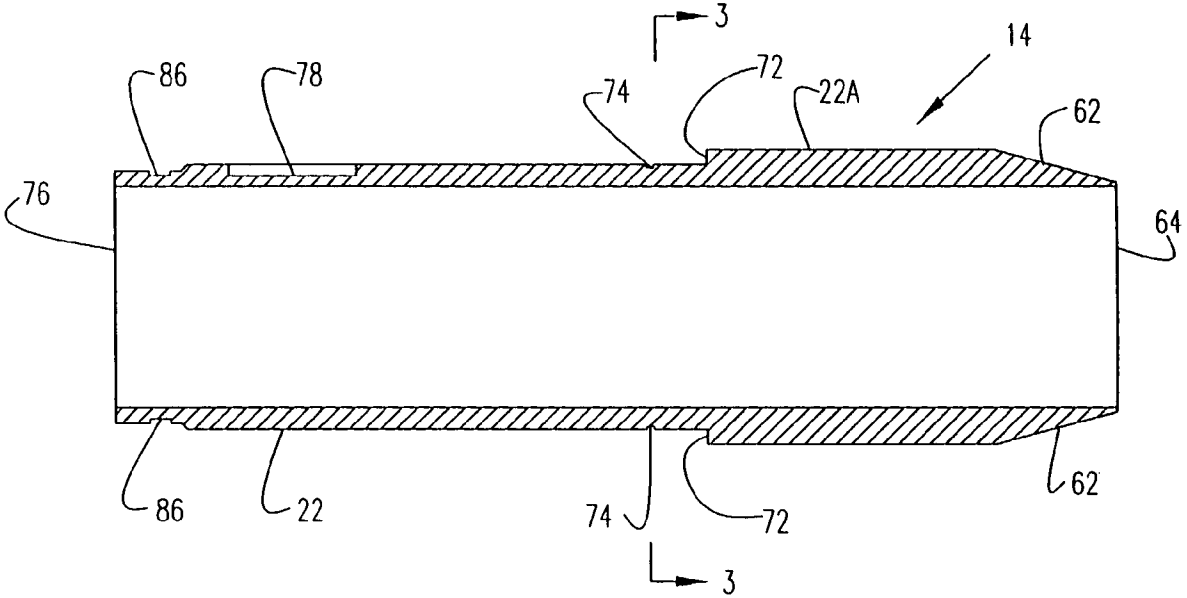
FIG. 2 is a cut away side view of an inner nozzle member of the automatically adjusting annular jet mixer of FIG. 1.
Figure 3:
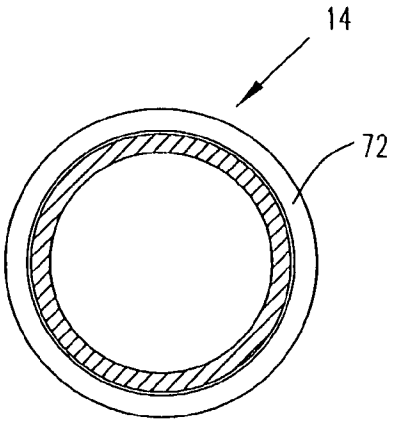
FIG. 3 is an end view of the inner nozzle member taken along line 3—3 of FIG. 2.

Referring now to FIGS. 1, 2 and 3, structural details of the inner nozzle 14 are illustrated. As illustrated in FIG. 2, a tapered section 62 of the external surface 22 of the nozzle 14 is tapered inwardly at the discharge end 64 so that the nozzle 14 decreases in its exterior diameter toward the discharge end 64. As shown in FIG. 1, the tapered section 62 of the nozzle 14 moves axially within an inwardly tapered portion 66 of the housing 12 so that the nozzle opening 18 is formed between the tapered section 62 of the nozzle 14 and the tapered portion 66 of the housing 12. Obviously, as the nozzle 14 moves axially within the housing 12, the nozzle opening 18 will decrease when the movement is in the direction of Arrow A, or alternately, will increase when the movement is in the direction of Arrow B.

The inner nozzle 14 is provided externally with the shoulder 72 for retaining the piston 20 on the second side 36 of the piston 20 and is provided externally with an indented area 74 where a piston retaining ring 75 seats to retain the piston 20 on the first side 26 of the piston 20.

Also, an opposite inlet end 76 of the nozzle 14 is provided with a traveling pin groove 78 in its external surface 22 for movably retaining a traveling pin 80 that inserts through a traveling pin opening 82 provided in an arm 84 of the alignment member 32. The inlet end 76 of the nozzle 14 is also provided with means for securing the nozzle 14 to existing equipment for introducing guar gum powder into the mixer 10, such as groove 86 for receiving a connecting collar 88.

Figure 4:
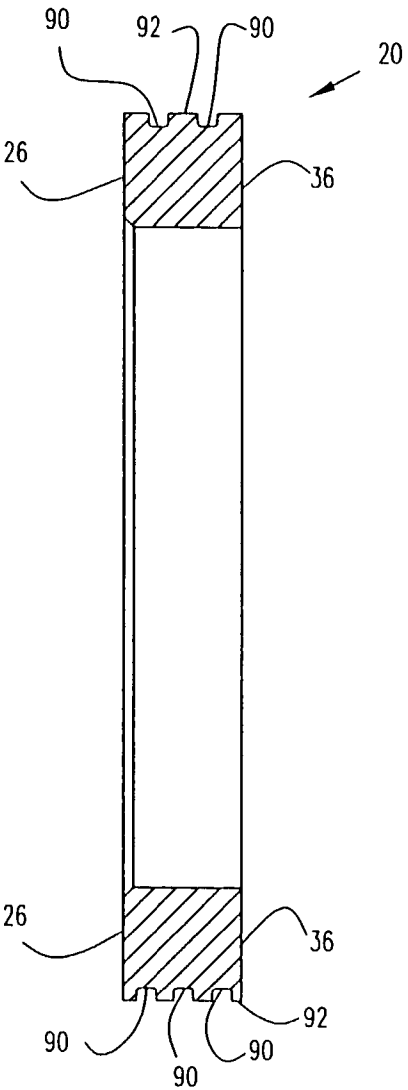
FIG. 4 is a cut away side view of a piston of the automatically adjusting annular jet mixer of FIG. 1.

Referring now to FIG. 4, the detailed structure of the piston 20 is illustrated. FIG. 4 shows a cut away side view of the circular piston 20 that secures to the inner nozzle member 14. The piston 20 is provided with a single helical groove 90 in the piston's external surface 92. The purpose of the helical groove 90 is to allow water to flow via the groove 90 between the pressure regulated and upstream cavities 24 and 34. This flow of water within the groove 90 and between the external surface 92 of the piston 20 and the inner surface 28 of the housing 12, thereby serves as a lubricant between the piston 20 and the inner surface 28 of the housing 12. The water flow within the groove 90 balances the pressures around the piston 20, thereby allowing the movable assembly, i.e. the piston 20 and the inner nozzle 14, to move more easily. Also, the groove 90 allows small particulates to pass without damaging surfaces. The lubrication provided by the water facilitates axial movement of the piston 20 and the attached inner nozzle 14 as a single unit within the housing 12.

Figure 5:
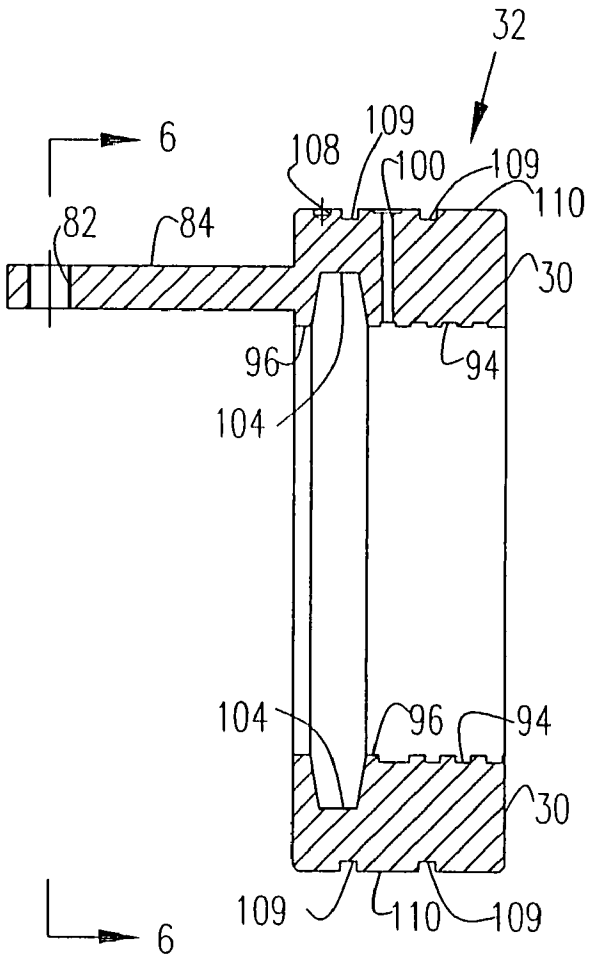
FIG. 5 is a cut away side view of an alignment member of the automatically adjusting annular jet mixer of FIG. 1 that prevents the inner nozzle member from rotating as it moves axially along the mixer centerline.
Figure 6:
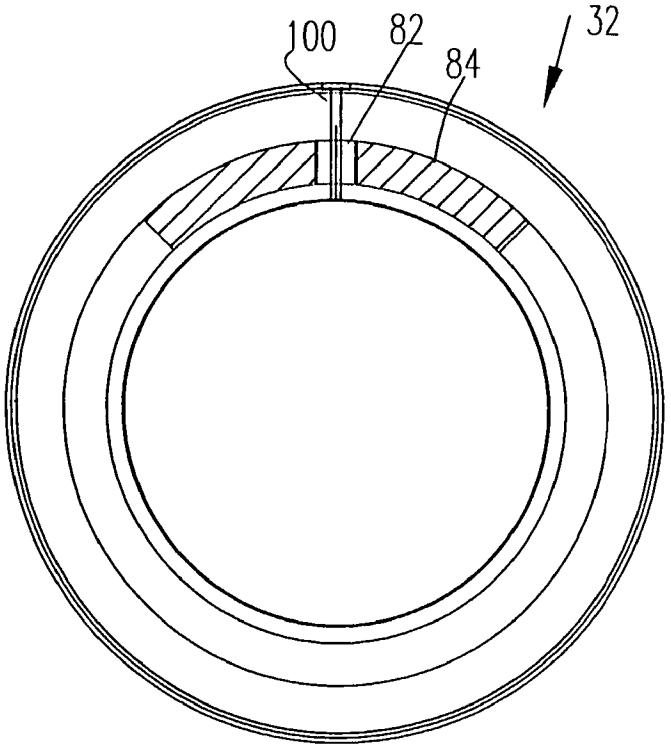
FIG. 6 is an end view of the alignment member taken along line 6—6 of FIG. 5.

Referring now to FIGS. 1, 5, and 6, the detailed structure of the alignment member 32 is illustrated. As previously described, the first end 30 of the alignment member 32 is provided with the arm 84 that extends longitudinally parallel with and adjacent to the external surface 22 of the inner nozzle 14. The arm 84 holds the traveling pin 80 within its traveling pin opening 82 and the traveling pin 80 extends downward into the groove 86 in the nozzle 14, thereby preventing the nozzle 14 from rotating relative to the housing 12 as the nozzle 14 moves axially within the housing 12.

The alignment member 32 is provided with a helical groove 94 in the inner surface 96 of the hollow alignment member 32. The helical groove 94 encircles the inner surface 96 a plurality of times. The helical groove 94 is located at the opposite second end 98 of the alignment member 32. The helical groove 94 is similar to the helical groove 90 provided in the piston 20 in that it allows water to flow through it so that the water can act as a lubricant. A small amount of water flows from the pressure regulated area 24, between the inner surface 96 of the alignment member 32 and the external surface 22 of the inner nozzle member 14 via the helical groove 94, and out of the mixer 10 via a drain opening 100 provided in and extending completely through both the alignment member 32 and the housing 12. Although the amount of water traveling through the helical groove 94 is small, it is an amount sufficient to lubricate the surfaces 96 and 22 and facilitate the axial movement of the inner nozzle member 14 and the attached piston 20 within the housing 12 without appreciably affecting the fluid pressure in the pressure regulated area 24.

The alignment member 32 is also provided with a low pressure seal 102 that resides in a seal indentation 104 that encircles the inner surface 96 of the hollow alignment member 32 adjacent to the arm 84. The low pressure seal 102 serves to prevent leakage of water from between the alignment member 32 and the inner nozzle member 14 upstream of the drain opening 100. The alignment member 32 secures to the housing 12 via set screws 106 that extend through set screw openings 107 provided in the housing 12 and engage set screw grooves 108 provided for this purpose in an external surface 110 of the alignment member 32 adjacent the first end 30 of the alignment member 32. The external surface 110 of the alignment member 32 is also provided with indentations 109 for seals 111. The alignment member 32 is also contained within the housing 12 by an internal snap ring 113, as illustrated in FIG. 1.

Figure 7:
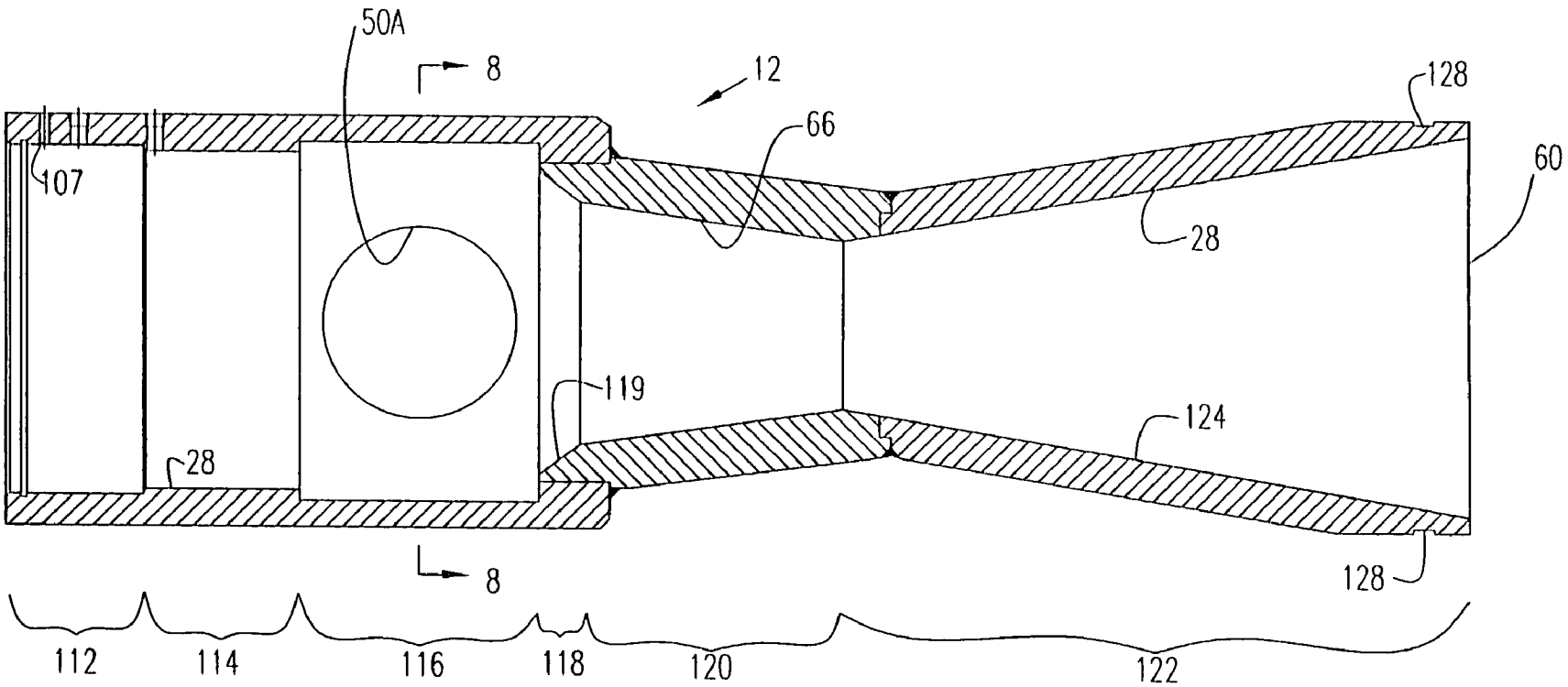
FIG. 7 is a cut away top view of a stationary housing of the automatically adjusting annular jet mixer of FIG. 1.

Referring now to FIGS. 7 and 8, there is illustrated detailed structure for the housing 12. FIG. 7 shows the housing 12 as being composed of approximately six distinct portions 112, 114, 116, 118, 120, and 122. Starting at the inlet end 76 and proceeding toward the mixture exit opening 60 of the housing 12, the portions encountered are as follows: a first portion 112 to which the alignment member 32 secures; a second portion 114 which is slightly smaller in diameter than the first portion 112 and houses the pressure regulated cavity 24 and the movable piston 20; a third portion 116 which is slightly larger in diameter than the second portion 114, houses the upstream cavity 34, and is provided with supply water inlets 50A and 50B that communicate through the housing 12; a fourth portion 118 which includes a sloped area 119 that decreases in diameter from the third portion 116 and allows water to flow from the upstream cavity 34 into the tapered section 62 of the inner nozzle member 14; a fifth portion 120 which further decreases in diameter from the fourth portion 118 and includes the previously described inwardly tapered portion 66 of the housing 12; and a sixth portion 122 which increases in diameter form the fifth portion 120 and includes an outwardly expanding tapered portion 124 that terminates at the mixture exit opening 60 of the housing 12.

As illustrated in FIG. 8, each of the supply water inlets 50A and 50B is provided with a groove, 126A and 126B respectively, for securing water lines 48A and 48B to the housing 12 at the supply water inlets 50A and 50B. Also, the mixture exit opening 60 of the housing 12 is provided with a groove 128 for securing the mixer 10 to typical downstream equipment, such as degassing equipment (not illustrated), prior to the guar gel mixture being pumped into a holding tank and fracturing blender and subsequently into an oil or gas well during a fracturing job.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A method for mixing wetable powder mixtures comprising:

injecting a wetable powder through a hollow inner nozzle of an automatically adjusting annular jet mixer, and pumping mix water into a upstream area provided in the automatically adjusting annular jet mixer between the inner nozzle and a hollow housing within which the inner nozzle axially moves so that the upstream area is pressurized and causes the inner nozzle to move relative to a housing of the mixer until the opposing forces exerted on the inner nozzle by the pressurized upstream area and an pressure regulated area that is pressurized at a regulated pressure are balanced and thereby adjusts the nozzle opening formed jointly by a tapered section of the inner nozzle and a inwardly tapered section of the housing so that high mixing energy is maintained to effectively wet the wetable powder with the supply water as the supply water exits the nozzle opening at all mixing rates.

2. A method for mixing wetable powder mixtures according to claim 1 wherein the injecting a wetable powder is guar gum.

3. A method for mixing wetable powder mixtures comprising:

injecting a wetable powder through a hollow inner nozzle of an automatically adjusting annular jet mixer, and pumping mix water into a upstream area provided in the automatically adjusting annular jet mixer between the inner nozzle and a hollow housing within which the inner nozzle axially moves, so that the upstream area is pressurized, maintaining a regulated pressure on an pressure regulated area provided in the automatically adjusting annular jet mixer thereby causing the inner nozzle to move relative to a housing of the mixer until the opposing forces exerted on the inner nozzle by the pressurized upstream area and the pressurized pressure regulated area are balanced and thereby adjusting the nozzle opening formed jointly by a tapered section of the inner nozzle and a inwardly tapered section of the housing so that high mixing energy is maintained to effectively wet the wetable powder with the supply water as the supply water exits the nozzle opening at all mixing rates.

4. A method for mixing wetable powder mixtures according to claim 3 wherein the injecting a wetable powder is guar gum.

5. A method for mixing wetable powder mixtures comprising:

injecting a wetable powder through a hollow inner nozzle of an automatically adjusting annular jet mixer, and pumping mix water into a upstream area provided in the automatically adjusting annular jet mixer between the inner nozzle and a hollow housing within which the inner nozzle axially moves, so that the upstream area is pressurized, maintaining a regulated pressure on a pressure regulated area provided in the automatically adjusting annular jet mixer, allowing the inner nozzle to move relative to a housing of the mixer until the opposing forces exerted on the inner nozzle by the pressurized upstream area and the pressurized pressure regulated area are balanced and thereby adjusting the nozzle opening formed jointly by a tapered section of the inner nozzle and a inwardly tapered section of the housing so that high mixing energy is maintained to effectively wet the wetable powder with the supply water as the supply water exits the nozzle opening at all mixing rates.

6. A method for mixing wetable powder mixtures according to claim 5 wherein the injecting a wetable powder is guar gum.

* * * * *